United States Patent [19]

Mower et al.

[11] 4,451,223

[45] May 29, 1984

[54] CORNER FINISHING TOOL

[75] Inventors: Morris F. Mower, Santa Clara; Eugene R. Johnson, Burlingame, both of Calif.

[73] Assignee: Bliss & Laughlin Industries, Inc., Oak Brook, Ill.

[21] Appl. No.: 402,618

[22] Filed: Jul. 28, 1982

[51] Int. Cl.[3] ..... B29C 23/00

[52] U.S. Cl. ..... 425/458; 425/87

[58] Field of Search ..... 425/87, 458

[56] References Cited

U.S. PATENT DOCUMENTS 3,932,101 12/1976 Johnson et al. ..... 425/458

*Primary Examiner*—Donald E. Czaja
*Assistant Examiner*—Mary A. Becker
*Attorney, Agent, or Firm*—Ernest M. Anderson

[57] ABSTRACT

An improved corner finishing tool for applying mastic along a wall joint and having a container that defines a cavity open in two convergent and substantially perpendicular planes, said cavity being bordered by surfaces that converge peripherally of said cavity, said container means comprising a pair of rigid retainer plates joined together by a pair of spring loaded hinges or fasteners and biased to a position of resilient flex. A pair of lever arms pivotally secured to an edge portion of the retainer plates and pivotally joined together at one end are acted upon by leaf springs which engage the lever arms at selected positions relative to the pivotal connection for adjusting the resilient flex between the pair of retainer plates. Mastic material is fed into the cavity through a socket bracket that is mounted to one of the retainer plates to which there is also mounted an alignment wheel.

3 Claims, 9 Drawing Figures

CORNER FINISHING TOOL

This application relates generally to corner finishing tools for applying mastic along a wall joint. Tools of this general nature are known in the art, but the invention described herein is believed to be a decided improvement thereon.f More particularly, the corner finishing tool of the present invention is similar to the corner finishing tool shown and described in our prior U.S. Pat. No. 4,116,604, but incorporates several features that make it a much improved device.

A principal object of the present invention is to provide a corner finishing tool that is easy to operate and which deposits a controlled amount of mastic material onto the corner of a wall joint.

Another object of the invention is to provide a corner finishing tool having an improved means for regulating the amount of flex between the sides of the tool.

Another object of the invention is to provide a corner finishing tool with an improved means for joining the retainer plates of the tool together.

Still another object of the invention is to provide a tool with an improved alignment means for the guide wheel.

And yet a further object of the invention is to provide a corner finishing tool with means for limiting the outward movement of the retainer plates.

Other objects of the invention will become apparent in view of the following detailed description of a preferred embodiment thereof.

In the drawings which form a part of this application, and in which like parts are identified by like reference numerals:

Figure 1:
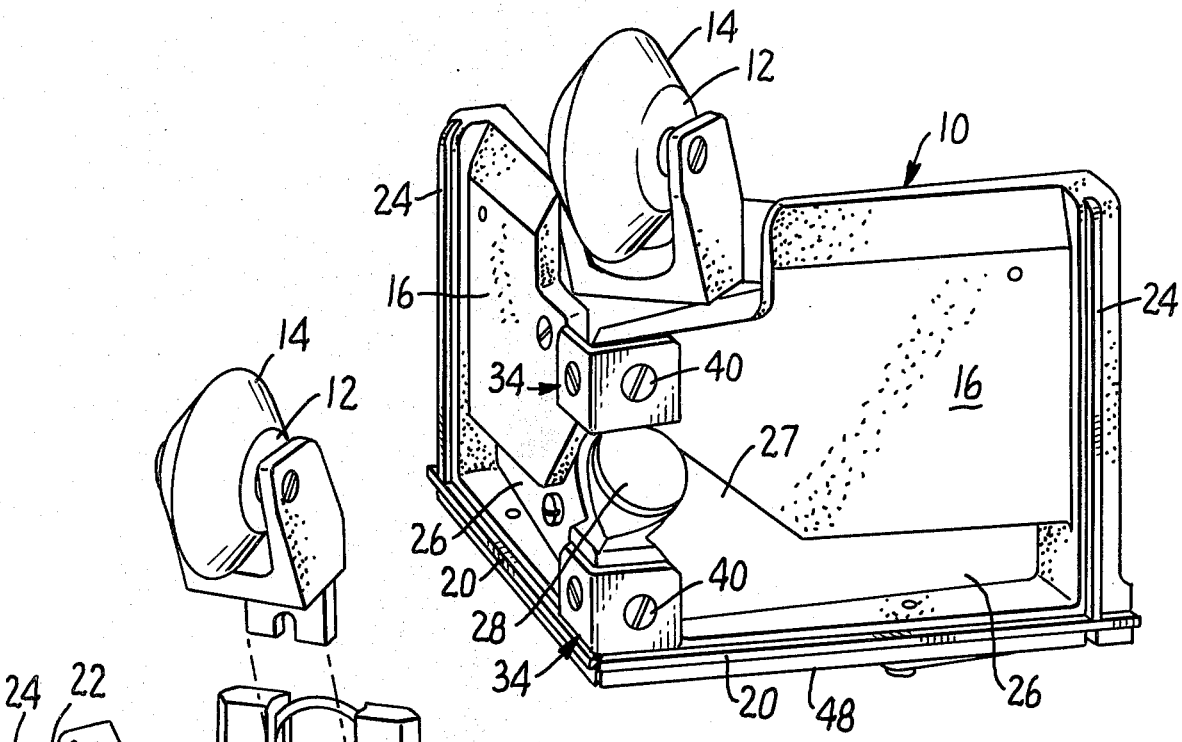
FIG. 1 is a perspective view of a preferred embodiment of the invention in a corner finishing tool.
Figure 2:
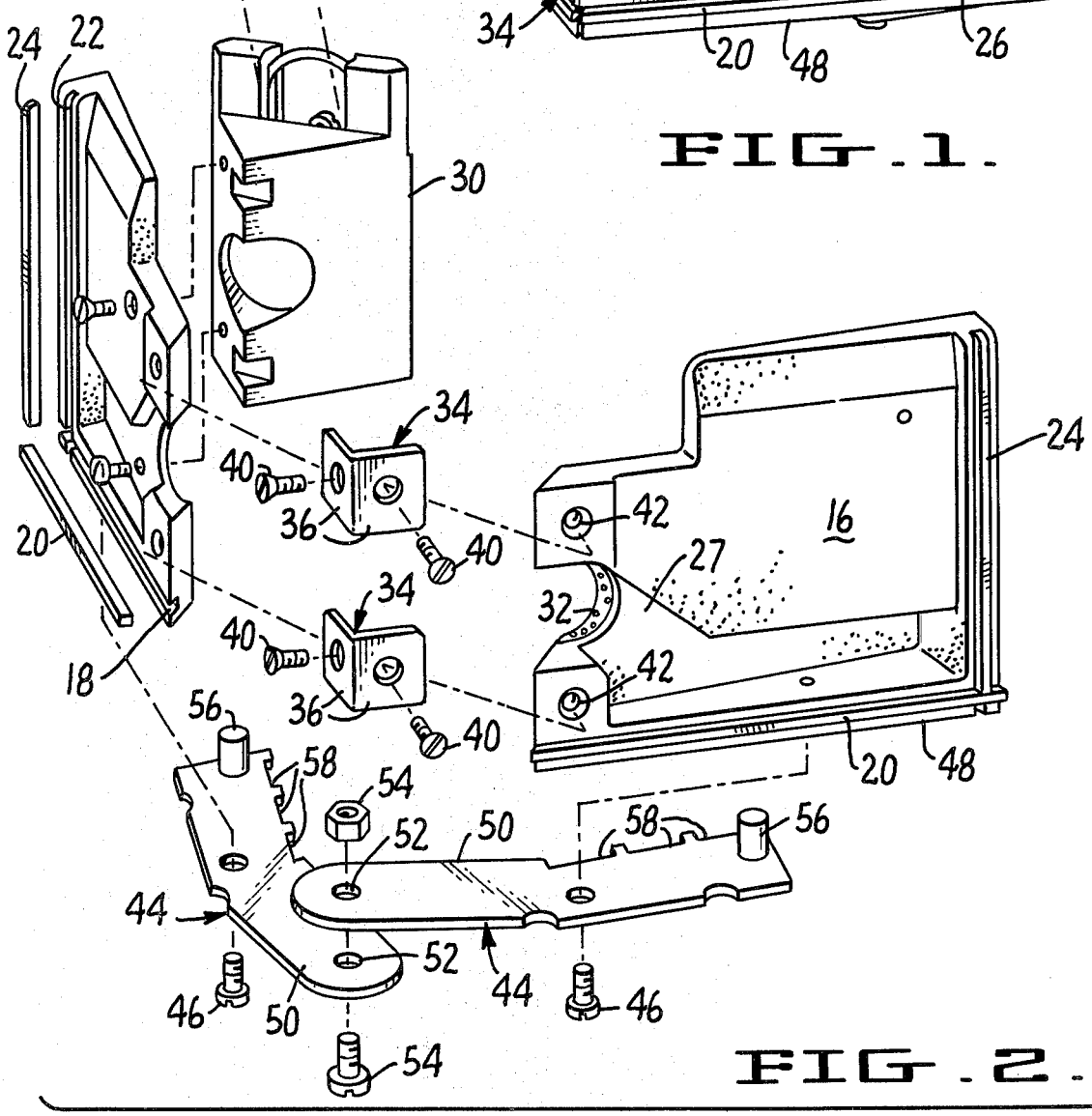
FIG. 2 is an exploded view of the corner finishing tool.
Figure 3:
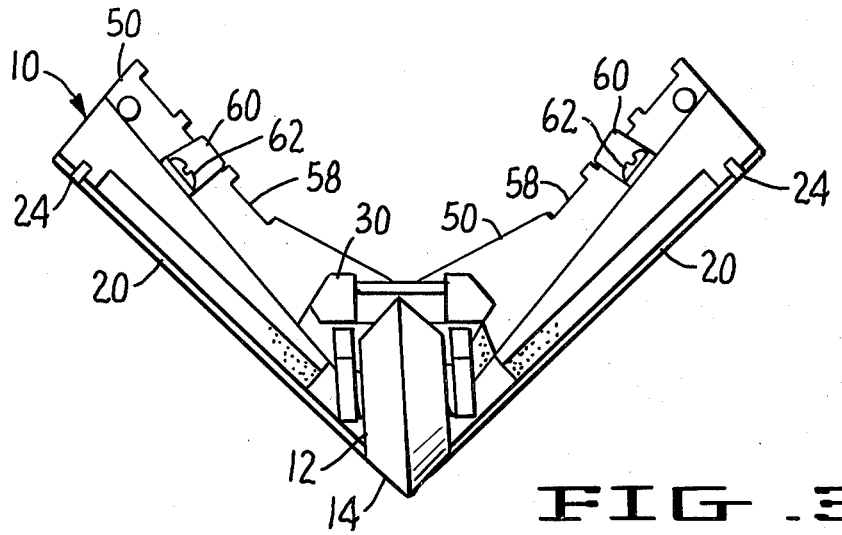
FIG. 3 is a top view of the finishing tool.
Figure 4:
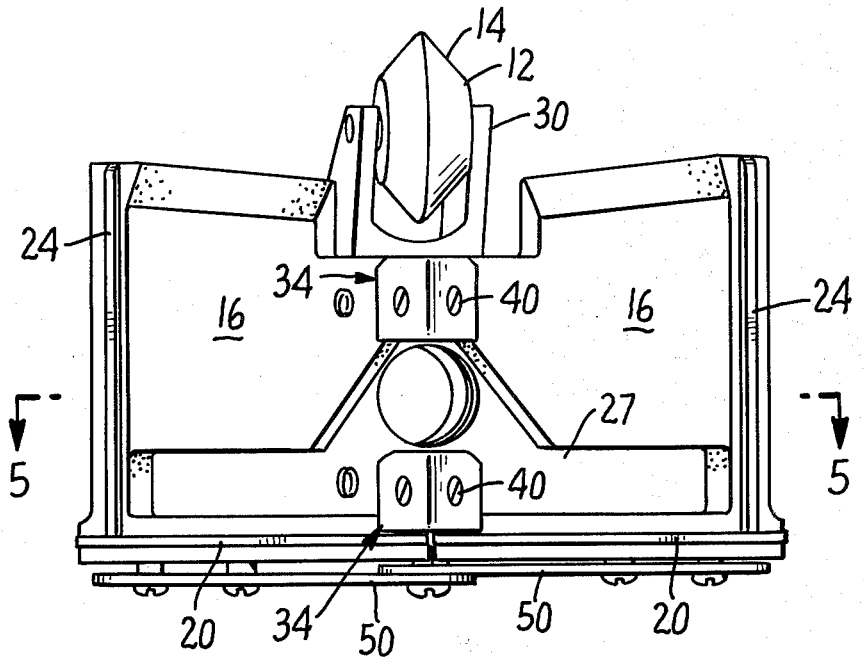
FIG. 4 is a front elevation of the finishing tool.
Figure 5:
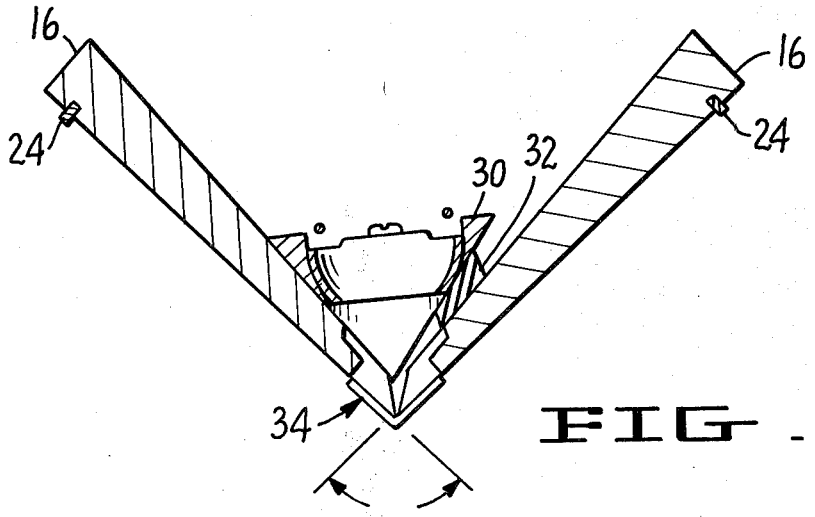
FIG. 5 is a sectional view taken on the horizontal line 5—5 in FIG. 4.
Figure 6:
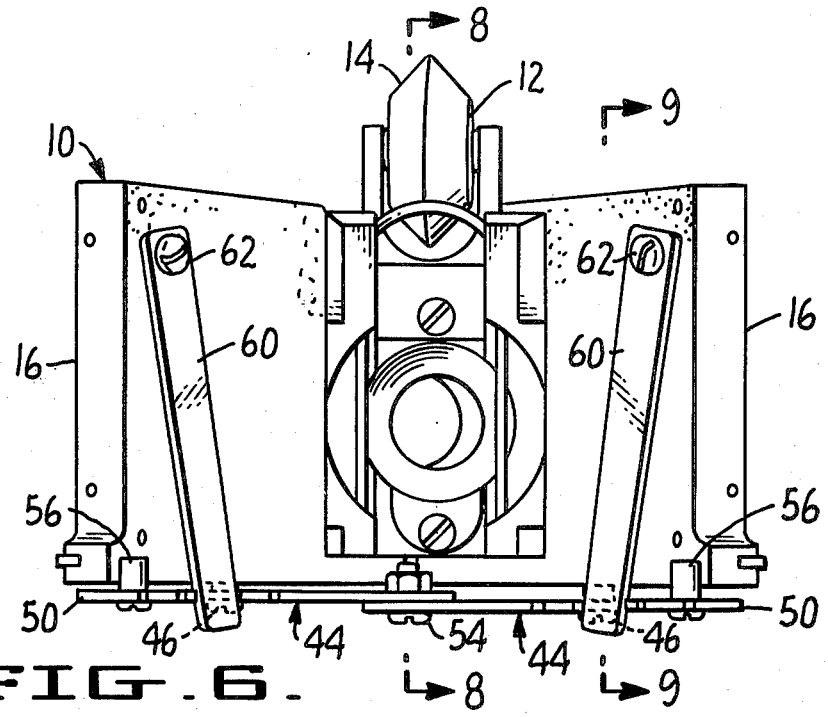
FIG. 6 is a rear elevation of the finishing tool.

As is customary in this art, the finishing tool 10 generally comprises a container means for mastic material defining a cavity that is open in two convergent and substantially perpendicular planes. The tool is provided with control surfaces that converge peripherally of the cavity for doctoring the flow of mastic material thereunder. Also in accord with customary practice, the tool 10 is provided with an alignment wheel 12 having conical surfaces 14 for engagement with the convergent walls of the surface to which the mastic is being applied. Notwithstanding the inclusion of these customary features, and unlike any other corner finishing tools known to the applicants, tool 10 embodies several improvements in construction which markedly improve the operation and effectiveness of the tool in the application of mastic to a wall joint.

The body of the tool 10 comprises a pair of cast aluminum retainer plates or frames 16, the thickness of which is sufficient to render the plates substantially rigid. Lateral grooves 18 are formed adjacent the lower edge portions of the plates to accomodate doctor blades 20. Similarly, the plates are provided with peripheral grooves 22 at right angles to the doctor blades to accomodate skids 24 for the tool. In keeping with the teachings of applicant's earlier patent, the plates are also formed with recesses 26 which form pockets for the collection of mastic material. As taught in said earlier patent, the provision of these pockets improves the application of the mastic by providing an even flow of material past the doctor blades. To insure proper filling of the pockets, the recesses 26 are communicated by passages 27 with the central supply opening 28 in the tool.

A conventional socket bracket 30 is provided for feeding mastic material into the mastic cavity defined by the plates 16, the doctor blades 20 and the skids 24. Bracket 30 also provides means for connecting the tool 10 to a mastic dispenser having a ball terminal, the construction of which is well known in the art. Unlike the teachings of the prior art, however, the socket bracket 30 is secured only to one of the plates rather than both. In the preferred embodiment shown and described herein, the bracket is secured to the right-hand plate (as viewed by the operator), but this is not critical and the bracket could as well be secured to the left-hand plate. In order to effect a seal with the left-hand plate and prevent the loss of mastic during operation, a gasket 32 is provided at the edge of the supply opening 28 formed in the plate. Securing the bracket 30 to only one of the retainer plates fixes the relationship of the alignment wheel with respect to that plate and leaves the wheel independent of the movement of the unattached left-hand plate.

The plates are joined together by means of a pair of spring loaded hinges or fasteners 34. Each hinge comprises a single piece of resilient metal that has been formed with a pair of flanges 36 disposed with respect to each other in substantially right-angle configuration. An opening 38 is provided in each flange to accomodate a screw fastener 40 and a similar opening 42 is also provided on each retainer plate adjacent the central supply opening so that the hinges may be secured by machine screws to the plates to join them together. In accord with the teachings of the invention, the angular relationship between the flanges 36 is greater than 90 degrees and preferably on the order of 105 degrees, although the angle could be as great as 110 degrees. This angular relationship of the hinges causes them to continuously exert on the retainer plates a spreading bias tending to maintain the doctor blades in operating contact with the convergent walls of the corner.

Tool 10 is also provided with an improved spring tension adjusting means. At the bottom of the tool, each plate carries a lever arm 44 which is secured by a machine screw 46 to the bottom edge portion 48 of the plate. Each lever arm has an inner, slightly canted portion 50 which serves to dispose an opening 52 at the inner end of the lever arm immediately behind the central axis of the tool and a loosely tightened machine screw and nut 54 serve as a pivot for the two lever arms. At the outer end, each lever arm is provided with a stop 56 that extends upwardly relative to the lever arm for engagement with the backside of the respective retainer plates. A series of slots 58 are formed in the back edge of each lever arm to receive the free ends of a pair of flat, leaf springs 60. The leaf springs are secured to the retainer plates adjacent the upper edges by a machine screw 62 and the slots are displaced from the plane of the body plates so that the placement of the lower ends of the leaf springs in the slots serves to place the lever arms under a spring tension tending to spread the plates. The amount of the tension on the retainer plates will vary depending upon which slot the springs are placed in inasmuch as each slot varies in distance from the fulcrum point 46 of the lever arms. Thus, when the leaf spring is placed in the outermost slot, the greatest amount of tension will be placed on the lever arms and, hence, on the plates. Likewise, when the leaf springs are placed in the innermost slot, the least amount of tension will be placed on the lever arms and retainer plates because this position is almost in line with the fulcrum point 46. Accordingly, by selectively placing the leaf springs in the different slots, the operator of the tool can vary the amount of tension on the plates.

Figure 7:
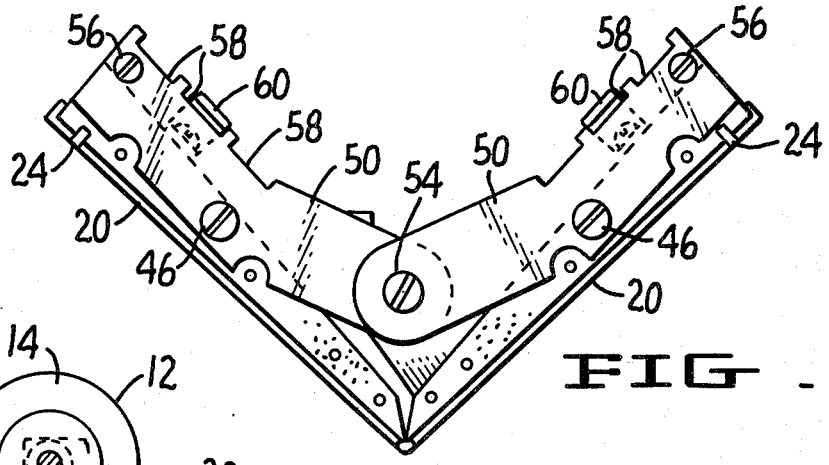
FIG. 7 is a bottom plan view of the tool.
Figure 8:
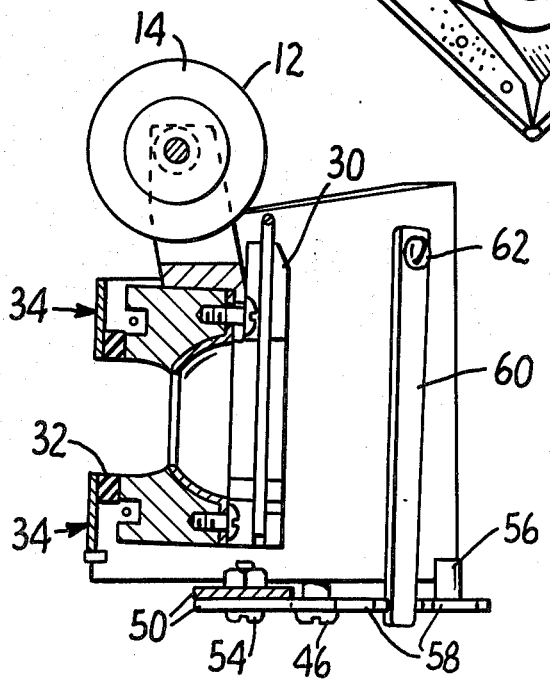
FIG. 8 is a sectional view taken on the vertical line 8—8 in FIG. 6.
Figure 9:
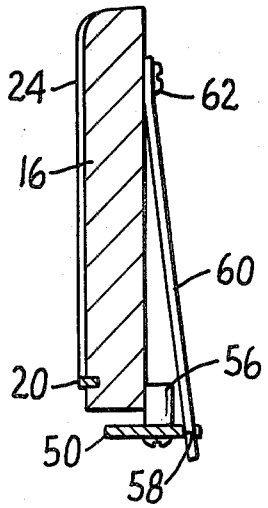
FIG. 9 is a sectional view taken on the vertical line 9—9 in FIG. 6.

The range of flex of the retainer plates 16 of the tool 10 is from approximately 86 to 95 degrees. This range provides a sufficient amount of flex to allow the tool to conform to the irregularities of the respective convergent wall surfaces forming the corner. It is necessary to limit the outward spread of the retainer plates for if the plates spread far enough the inner ends of the doctor blades 20 will impinge on one another and break. Outward movement of the plates causes the lever arms to pivot about their fulcrums 46. As is best seen in FIG. 7, the right-hand lever arm pivots in a clockwise direction while the left-hand lever arm pivots in a counter-clockwise direction. This pivotal movement of the lever arms brings the stops 56 into engagement with the backsides of the plates and prevents them from spreading any farther.

Although a preferred embodiment of the invention has been illustrated and described, various modifications and changes may be resorted to without departing from the spirit of the invention or the scope of the appended claims, and each of such modifications and changes is contemplated.

We claim:

1. An improved corner finishing tool for applying mastic material along a wall joint, said tool comprising container means defining a cavity that is open in two convergent and substantially perpendicular planes and having surfaces in each of said planes that converge peripherally of said cavity; said container means comprising a pair of retainer plates resiliently joined at one edge, a pair of doctor blades mounted along intersecting edges of said retainer plates for doctoring mastic material that flows thereunder; and improved means for adjusting the resilient flex between said pair of retainer plates comprising a pair of lever arms pivotally secured to an edge portion of the retainer plates and pivotally joined together at one end, and spring means for engaging the lever arms at selected positions relative to the pivotal connection between the retainer plates and the lever arms.

2. The corner finishing tool of claim 1, further comprising stop means on the lever arms for engagement with the retainer plates to limit the outward spread thereof.

3. The corner finishing tool of claim 1, wherein said lever arms are provided with a plurality of slots formed in the edge portion rearwardly disposed of said retainer plates and a pair of flat leaf springs are fixed at one end to the retainer plates and the opposite free ends are selectively disposed within said slots.

* * * * *